United States Patent [19]

Babiol

[11] 4,106,656

[45] Aug. 15, 1978

[54] COMPOSITE STOPPER

[75] Inventor: Pierre Babiol, Villefranche-sur-Saone, France

[73] Assignee: Societe Nouvelle de Bouchons Plastiques, S.N.B.P., Paris, France

[21] Appl. No.: 732,222

[22] Filed: Oct. 14, 1976

[30] Foreign Application Priority Data

Oct. 20, 1975 [FR] France ..... 75 32390

[51] Int. Cl.[2] ..... B65D 39/00

[52] U.S. Cl. ..... 215/364; 220/352; 222/563

[58] Field of Search ..... 215/364; 220/352; 222/563

[56] References Cited

U.S. PATENT DOCUMENTS

| | | | |
|---|---|---|---|
| 2,925,187 | 2/1960 | Bramming | 215/364 |
| 2,934,231 | 4/1960 | Bramming | 215/364 |
| 2,940,107 | 6/1960 | Sterling | 215/364 |
| 3,628,686 | 12/1971 | Burton | 215/364 |

*Primary Examiner*—Ro E. Hart

*Attorney, Agent, or Firm*—Dowell & Dowell

[57] ABSTRACT

A composite stopper comprises a body of resilient plastics material and a head surmounting the body. The head has a skirt extending around the body and a sleeve which is force fitted into a blind recess in the body. The fit of the sleeve causes the adjacent body portion to expand into engagement with the inner surface of the skirt.

4 Claims, 3 Drawing Figures

COMPOSITE STOPPER

This invention relates to stoppers, particularly though not exclusively to bottle stoppers for example stoppers for bottles of Cognac.

Such stoppers generally comprise a body of cork surmounted by a head of wood or of plastics material.

Because of the continually increasing price of cork an object of the invention is to provide a stopper in which cork is not utilized.

According to the invention there is provided a composite stopper comprising a body and a head which surmounts the body and has a peripheral portion extending around the body, said body being of a resilient plastics material and having a blind recess, and said head including a sleeve which is force fitted into said recess to cause the adjacent portion of the body, to expand into engagement with said peripheral portion of the head.

The expansion of the body portion into engagement with the peripheral portion of the head renders the body integral with the head and enables a composite stopper which does not come apart when it is being used, to be provided.

In order that the invention may be well understood, two embodiments thereof, which are given of example only, will now be described, reference being had to the accompanying drawings in which.

Figure 1:
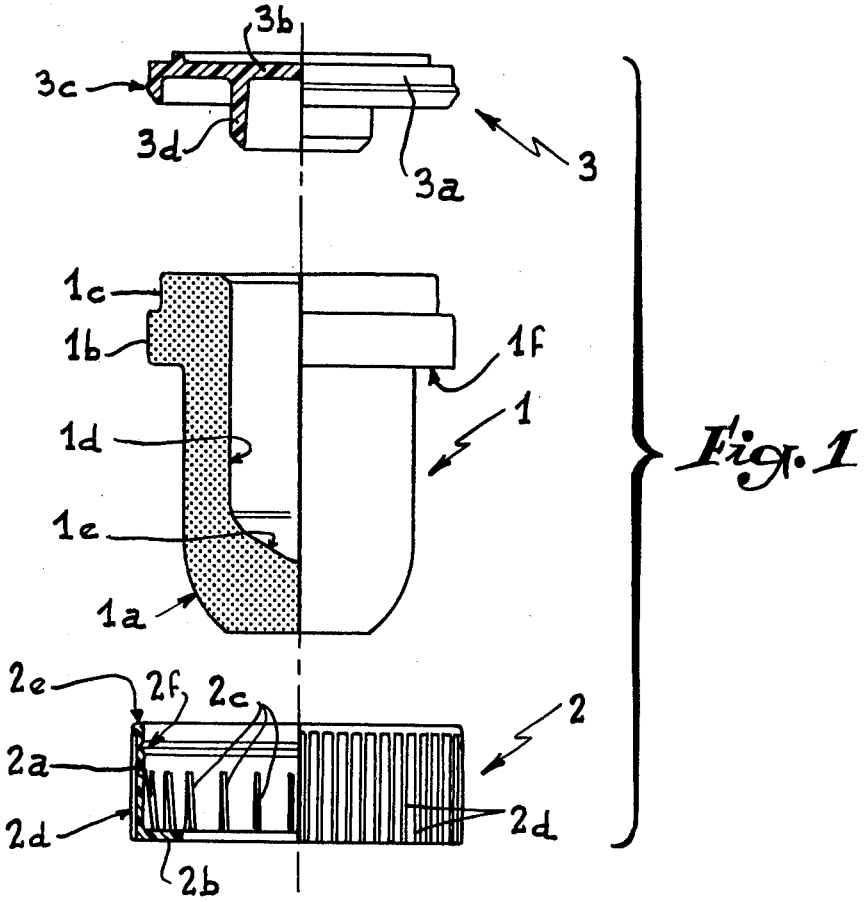
FIG. 1 is an exploded view of a composite stopper.
Figure 2:
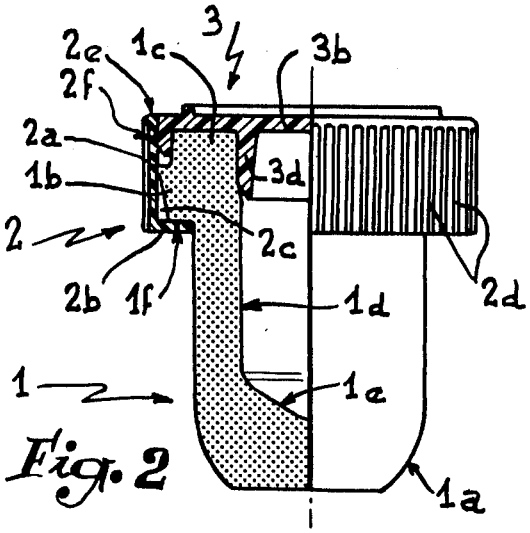
FIG. 2 is an external view with a semi-section of the same stopper.

The composite stopper shown in FIGS. 1 and 2 comprises a body 1, and a head which itself comprises an annular skirt member or cage 2 and a further, generally disc-like member 3.

The body 1 produced in a synthetic cellular resilient plastics material, had a generally cylindrical portion, one of the ends of which is provided with a rounded chamfer 1*a* whilst the opposite end thereof is provided with a flange 1*b* of a diameter greater than that of the generally cylindrical portion and which is surmounted by a boss 1*c* the diameter of which is intermediate between that of the generally cylindrical portion and of the flange 1*b*. A central blind recess 1*d*, the base 1*e* of which is substantially conical, is provided in the body 1 and opens at the outer surface of the boss 1*c*.

The cage 2 of the head is made in the form of a tubular skirt 2*a* the lower portion (as viewed in the drawings) of which is integral with an annular ring 2*b* orientated perpendicularly to the skirt.

The diameter of the bore in the annular ring 2*b* corresponds approximately to the outer diameter of the generally cylindrical portion of the body 1 whilst the inner diameter of the skirt 2*a* is very slightly less than that of the flange 1*b* on the body 1. As shown in the drawing, the inner surface of the skirt 2*a* is provided with longitudinal grooves 2*c* which open radially inwardly of the skirt and which are preferably in the shape of a triangle the base of which rests against the corresponding surface on the ring 2*b*. The outer surface of the skirt 2*a* is provided with longitudinal channels 2*d* for assisting gripping of the head.

As is shown in FIG. 2, the body 1 is engaged in the bore of the ring 2*b* of the cage 2 until a shoulder 1*f* of the flange 1*b* abuts against the inner surface of the annular ring 2*b* of the cage 2. At this instant, the periphery of the flange 1*b* rests lightly against the inner surface of the skirt 2*a*. The total height of the flange 1*b* and of the boss 1*c* is made less than that of the skirt 2*a* of the cage 2 so that a certain distance exists between the top of the boss 1*c* and the free edge 2*e* of the skirt 2*a* when the body 1 is engaged within the cage, whilst an annular free space exists between the periphery of the boss 1*c* and the inner surface of the skirt.

To form the head of the stopper the top of the cage 2 is closed by means of the generally disc-like member 3. The latter is provided with a peripheral rim 3*a* perpendicular to it's base portion 3*b*, the rim being provided on it's outer surface with a lip 3*c* intended to latch elastically within a groove 2*f* formed in the upper part of the inner surface of the skirt 2*a* of the cage 2 to enable the member 3 to be snap-fitted within the cage 2. The height of the rim 3*a* is of course made less than that of the annular free space existing between the circumference of the boss 1*c* and the cage 2.

The base 3*b* of the disc 3 is also provided with a tubular sleeve 3*d* the outer diameter of which is greater that the diameter of the recess 1*d* in the body 1. Thus, when the member 3, which is made of a rigid plastics material, is arranged in place, the tubular sleeve 3*d* which is force fitted into the recess 1*d* causes the adjacent portion of the body to expand into engagement with the inner surface of the skirt 2*a* the flange 1*b* of the body thereby being keyed with the grooves 2*c* of the skirt. Thus, it becomes, impossible to cause the head produced by the assembly of the members 2 and 3 to turn with respect to the body 1 so that the composite stopper assembly cannot come apart whilst it is in use.

The cage 2 is advantageously made in a rigid plastics material such as polystyrene; nevertheless it has sufficient elasticity to enable the disc 3 to be arranged in place.

Figure 3:
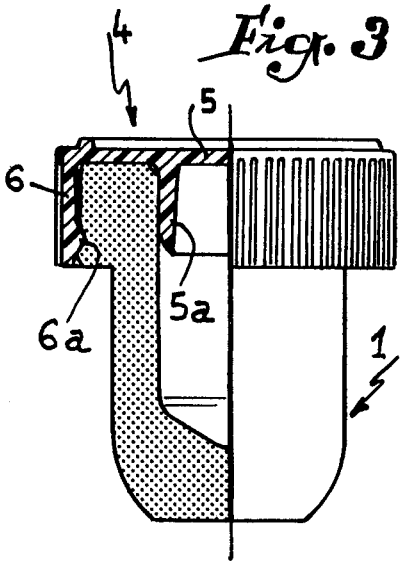
FIG. 3 is a view similar to that of FIG. 2 but showing a modified stopper.

As shown in the modified stopper illustrated in FIG. 3, the head of the stopper can be produced in one single piece 4 comprising a base 5 provided with a central tubular sleeve 5*a* similar to sleeve 3*d* in the embodiment described above. The ring 2*b* on the annular skirt of the previous embodiment is omitted to enable assembly of the stopper but the interior of the annular skirt 6 of the head 4 includes a bead 6*a* turned inwardly which prevents relative movement of the body 1 and the head 4 apart.

It is of course to be further understood that the preceding description has been given only by way of example and that it in no way limits the scope of the invention which would not be departed from by replacing the particular details described by any other equivalents.

We claim:

1. A composite stopper comprising:

a body made of resilient deformable plastic material, the body having a cylindrical portion and having a central blind recess extending axially downwardly thereinto, and the body having an annular flange of diameter greater than the cylindrical portion extending around the cylindrical portion opposite said blind recess;

a cage member comprising a tubular skirt of diameter fitting over said flange, the skirt having an annular ring extending radially inwardly and terminating in an axial bore of diameter fitting said cylindrical portion of the body, the annular ring underlying the flange and the skirt extending up the flange; and a disc-like member having a downwardly extending peripheral rim shaped to axially enter said skirt and overlie said resilient body, and the member having a downwardly extending axially disposed sleeve of diameter larger than said blind recess, the sleeve being force fitted within the body when the rim of the disc-like member is entered in the skirt and expanding the body into tight engagement with said skirt.

2. A stopper as set forth in claim 1, wherein the inner surface of the tubular skirt is provided with axially extending grooves into which the resilient material of the body is expanded whereby to prevent relative rotation between the skirt and the body.

3. A stopper as set forth in claim 1, wherein the peripheral rim and the skirt have interengaging groove and lip means which snap fit together when the rim is entered between the skirt and the resilient body.

4. A stopper as set forth in claim 1, wherein said body includes a boss of reduced diameter therearound above said flange and disposed to leave an annular space between the skirt and the body to receive said rim of the disc-like member.

* * * * *